US010773151B2

(12) United States Patent
Waldman et al.

(10) Patent No.: US 10,773,151 B2
(45) Date of Patent: Sep. 15, 2020

(54) GAMING TAG SYSTEM

(71) Applicant: NSI INTERNATIONAL, INC., New York, NY (US)

(72) Inventors: Brian K. Waldman, New York, NY (US); Frank J. Landi, Jr., New York, NY (US); Chan Kok Wing Farra, Kwai Chung (HK); Chu Ki Kwan, Kwai Chung (HK)

(73) Assignee: NSI INTERNATIONAL, INC., New York, NY (US)

( * ) Notice: Subject to any disclaimer, the term of this patent is extended or adjusted under 35 U.S.C. 154(b) by 317 days.

(21) Appl. No.: 15/893,088

(22) Filed: Feb. 9, 2018

(65) Prior Publication Data

US 2018/0229108 A1 Aug. 16, 2018

Related U.S. Application Data

(60) Provisional application No. 62/458,266, filed on Feb. 13, 2017, provisional application No. 62/503,059, filed on May 8, 2017.

(51) Int. Cl.
*A63F 9/24* (2006.01)
*A63F 9/02* (2006.01)
(Continued)

(52) U.S. Cl.
CPC ..... *A63F 9/0291* (2013.01); *A63F 9/0252* (2013.01); *A63F 9/24* (2013.01);
(Continued)

(58) Field of Classification Search
CPC ..... A63F 9/0291; A63F 9/24; A63F 9/0252; A63F 2250/49; A63F 2009/2447;
(Continued)

(56) References Cited

U.S. PATENT DOCUMENTS 3,921,947 A * 11/1975 Adam ..... F16M 11/14 248/169
5,741,185 A * 4/1998 Kwan ..... A63F 9/0291 434/22

(Continued)

OTHER PUBLICATIONS

Resident Evil 4 Wii edtion manual. Capcom. May 16, 2007. Accessed via the Internet. Accessed Feb. 14, 2020. <URL: http://static.capcom.com/manuals/re4/RE4_WII_DMNL_EN.pdf> (Year: 2007).*

(Continued)

*Primary Examiner* — Dmitry Suhol
*Assistant Examiner* — Carl V Larsen
(74) *Attorney, Agent, or Firm* — Andrew F. Young, Esq.; Lackenbach Siegel, LLP

(57) ABSTRACT

A gaming system may include: an infrared signal emitter configured to emit an infrared signal, the infrared emitter being configured to emit a predetermined number of emissions per a simulated reloading action, the infrared signal being configurable to be associated with one of at least a first team, a second team, and a neutral team, the infrared signal emitter including a handle to be grasped by a player and a trigger to effect emission of the infrared signal; and an infrared signal receiver configured to receive the infrared signal associated with one of the at least the first team, the second team, and the neutral team. Optionally, the gaming system may include a stationary receiver and emitter for integrated use with game players in a further modification of the methods and uses herein. The stationary receiver and emitter may receive and transmit signals, store a memory of activities, teams, players, and other game-playing benefits.

16 Claims, 16 Drawing Sheets

(51) Int. Cl.
*F41J 5/08* (2006.01)
*F41A 33/02* (2006.01)

(52) U.S. Cl.
CPC ..... *F41A 33/02* (2013.01); *F41J 5/08* (2013.01); *A63F 2009/2444* (2013.01); *A63F 2009/2447* (2013.01); *A63F 2009/2472* (2013.01); *A63F 2009/2479* (2013.01); *A63F 2009/2485* (2013.01); *A63F 2250/49* (2013.01)

(58) Field of Classification Search
CPC ..... A63F 2009/2479; A63F 2009/2472; A63F 2009/2444; A63F 2009/2485; F41A 33/02; F41J 5/08
See application file for complete search history.

(56) References Cited

U.S. PATENT DOCUMENTS 6,261,180 B1 * 7/2001 Lebensfeld ..... A63F 9/0291 463/49
6,302,796 B1 * 10/2001 Lebensfeld ..... A63F 9/0291 446/175
6,328,651 B1 * 12/2001 Lebensfeld ..... A63F 9/0291 463/49
8,469,824 B1 * 6/2013 Farley ..... F41J 5/02 434/11
2006/0287114 A1 * 12/2006 Luong ..... A63F 9/02 463/51
2009/0075241 A1 * 3/2009 Ha ..... F41A 33/02 434/22
2013/0072269 A1 * 3/2013 Chen ..... A63B 5/11 463/7
2015/0031422 A1 * 1/2015 Yuen ..... F41A 33/02 463/5
2016/0377367 A1 * 12/2016 Davis, III ..... F41J 5/02 463/52
2017/0259183 A1 * 9/2017 Matloff ..... F41A 33/02
2018/0353845 A1 * 12/2018 Fischer ..... A63F 9/24

OTHER PUBLICATIONS

Wii Remote. Wikipedia.org. Online. Nov. 19, 2006. Accessed via the Internet. Accessed Feb. 14, 2020. <URL: https://en.wikipedia.org/wiki/Wii_Remote> (Year: 2006).*

* cited by examiner

GAMING TAG SYSTEM

CROSS REFERENCE TO RELATED APPLICATIONS

This application relates to and claims priority from U.S. Prov. App. Ser. No. 62/458,266, was filed Feb. 13, 2017 and U.S. Prov. App. Ser. No. 62/503,059, filed on May 8, 2017, the entire contents of which are incorporated herein by reference.

FIGURE SELECTED FOR PUBLICATION

FIG. 1

BACKGROUND OF THE INVENTION

Field of the Invention

The present invention relates generally to a simulated gun and more particularly to a toy that transmits an electronic signal, preferably in the infrared (IR) band range for use in a game in combination with a receiving unit.

Description of the Related Art

"Laser" tag is a tag game that is played with toy guns that emit a laser. Typically, lasers are "fired" into receivers that score hits. While 'laser' tag sometimes employs actual lasers (collimated light e.g., the acronym LASER is Light Amplification by Stimulated Emission of Radiation), often this is merely an enticing marketing phrase, and the actual signal transmitted is in the nature of another type of transmission, such as infrared (IR) or ultraviolet (UV), such as with an audio visual remote.

ASPECTS AND SUMMARY OF THE INVENTION

The present invention relates generally to a gaming system, and in particular to a gaming system that utilizes infrared signals for such games as laser tag, for example.

In an embodiment, the gaming system may include: an infrared signal emitter configured to emit an infrared signal, the infrared emitter being configured to emit a predetermined number of emissions per a simulated reloading action, the infrared signal being configurable to be associated with one of at least a first team, a second team, and optionally a neutral team (e.g., a third team) and further optionally a plurality of teams (more than three), wherein each team may optionally have a plurality of players (more than 2/team and with an upper limit per team) and optional variations of the same; the infrared signal emitter including a handle to be grasped by a player and a trigger to effect emission of the infrared signal; and an infrared signal receiver configured to receive the infrared signal associated with one of the at least the first team, the second team, and the optionally neutral team. The receiver or signal-target may either be worn by the player on a body part including, for example, the chest and/or it may be coupled to the emitter, or may be optionally affixed to the handle/gun member. The infrared signal receiver may be configured to determine proximity of the received emitted infrared signal relative to the infrared signal receiver. The simulated reloading event may occur based upon a number of actuation events, including: pulling a trigger and shaking a motion sensor (internal), moving a motion sensor in a particular form (e.g., forward and back, see drawings), or other combinations thereof, or other defined motions without limit as long as the system itself is programmed to recognize the designated combination as a reloading action, or other action. A simulated reloading indicator may include a sound or color or vibration result, or a combination thereof.

In a further embodiment, a gaming system may include: a first infrared signal emitter configured to emit an infrared signal, the infrared emitter being configured to emit a predetermined number of emissions per a simulated reloading action, the infrared signal being configurable by a process controller to be associated with one of at least a first team, a second team, and a neutral team, the infrared signal emitter including a handle to be grasped by a player and a trigger to effect emission of the infrared signal; a first infrared signal receiver configured to receive the infrared signal associated with one of the at least the first team, the second team, and the neutral team, the infrared signal receiver being operably joined to said infrared signal emitter and including a user harness to prevent unintended separation during a gaming session; and a gaming tower configured to be placed at a stationary location, the gaming tower comprising: a housing; a plurality of legs deployable from the housing to support the housing in an upright position; a light disposed in the housing, the light providing a visual indication of a game mode; at least one second infrared receiver disposed in the housing, the receiver configured to receive the infrared signal from the first infrared signal emitter; and at least one second infrared emitter disposed in the housing and configured to transmit an infrared signal to the first infrared signal receiver.

According to an embodiment, a gaming system may include a first infrared signal emitter configured to emit a first infrared signal, the first infrared emitter being configured to emit a predetermined number of emissions per a simulated reloading action, the first infrared signal being configurable by a process controller to be associated with one of at least a first team, a second team, and a neutral team, the first infrared signal emitter including a first handle to be grasped by a player and a trigger to effect emission of the first infrared signal; a second infrared signal receiver configured to receive the first infrared signal associated with one of the at least the first team, the second team, and the neutral team, the infrared signal receiver being operably joined to said infrared signal emitter and including a user harness to prevent unintended separation during a gaming session. The gaming system may further include a second handle positioned proximally relative to the first handle, the trigger being disposed along a length of the second handle, the first handle being slidable toward and away from the the second handle to effect the simulated reloaded action. The infrared signal emitter may further include a motion sensor, and wherein the simulated reloading action includes pressing the trigger and shaking the motion sensor. The first infrared signal receiver may be configured to determine proximity of a source of the received emitted infrared signal relative to the first infrared signal receiver. A gaming tower configured to be placed at a stationary location, and the gaming tower may include: a housing; a second infrared signal emitter configured to emit a second infrared signal; at least one second infrared signal receiver configured to receive the first infrared signal, wherein reception of the first infrared signal by the second infrared signal receiver results in a predetermined response, which may include, among other things, for example, setting a game play mode. The game play mode may include at least setting a timer, e.g., setting a duration of game play. The game play mode may additionally or alternatively include emitting the second infrared signal by the second infrared signal emitter upon receiving the first infrared signal by the second infrared signal receiver. The at least one second infrared signal receiver may include a first team infrared signal receiver and a second team infrared signal receiver. For example, a first team may score points for accurately targeting the first receiver and the second team may score points for accurately targeting the second receiver. The gaming tower may be configured to have an adjustable height, which may be accomplished by at least one leg that may be pivotable relative to the housing such that the adjustable height is settable at least at a first height and a second height.

In a further embodiment, a gaming system may include: a housing having a first end and a second end; a first handgrip extending from from the housing and being configured to be grasped by a player, the first handgrip being disposed between the first and second ends; a signal emitter disposed at the second end; a computer having a processor and a memory; and a motion sensor being disposed within the housing, the motion sensor being configured to detect a shaking movement, the shaking movement being configured to effect a simulated reloading action, the simulated reloading including at least one of a sound, color, and vibration, the simulated reloading effecting a predetermined number of shooting rounds, each of the shooting rounds being a signal emission by the signal emitter, the signal emission being an infrared signal. The system may further include a wearable signal receiver.

In an embodiment, a gaming system may include: a housing having a first end and a second end; a first handgrip extending from from the housing and being configured to be grasped by a player, the first handgrip being disposed between the first and second ends; a second handgrip disposed at the first end, the first handgrip being slidable relative to the second handgrip; a signal emitter disposed at the second end; and a computer having a processor and a memory, wherein sliding of the first handgrip and the second effects a simulated reloading, the simulated reloading effecting a predetermined number of shooting rounds, each of the shooting rounds being a signal emission by the signal emitter, the signal emission being an infrared signal. The system may further include a wearable signal receiver.

In a further embodiment, a gaming system may include: a housing configured to be placed at a stationary location; an infrared signal emitter configured to emit a second infrared signal; at least one infrared signal receiver configured to receive the first infrared signal, wherein reception of the first infrared signal by the second infrared signal receiver results in a predetermined response; and a computer having a processor and a memory, the memory including at least one instruction for effecting a predetermined response in response to the at least one second infrared signal receiver detecting an infrared signal from at least one of a first and a second team. The at least one infrared signal receiver may include a first infrared signal receiver and a second infrared signal receiver, wherein the predetermined response differs based on whether the first or the second infrared signal receiver detects the infrared signal. A first colored light may be associated with the first signal receiver and a second colored light may be associated with the second signal receiver.

The above and other aspects, features and advantages of the present invention will become apparent from the following description read in conjunction with the accompanying drawings, in which like reference numerals designate the same elements.

BRIEF DESCRIPTION OF THE DRAWINGS

A further understanding of the present invention can be obtained by reference to a preferred embodiment set forth in the illustrations of the accompanying drawings. Although the illustrated preferred embodiment is merely exemplary of methods, structures and compositions for carrying out the present invention, both the organization and method of the invention, in general, together with further objectives and advantages thereof, may be more easily understood by reference to the drawings and the following description. The drawings are not intended to limit the scope of this invention, which is set forth with particularity in the claims as appended or as subsequently amended, but merely to clarify and exemplify the invention.

For a more complete understanding of the present invention, reference is now made to the following drawings in which.

DETAILED DESCRIPTION OF THE PREFERRED EMBODIMENTS

Figure 1:
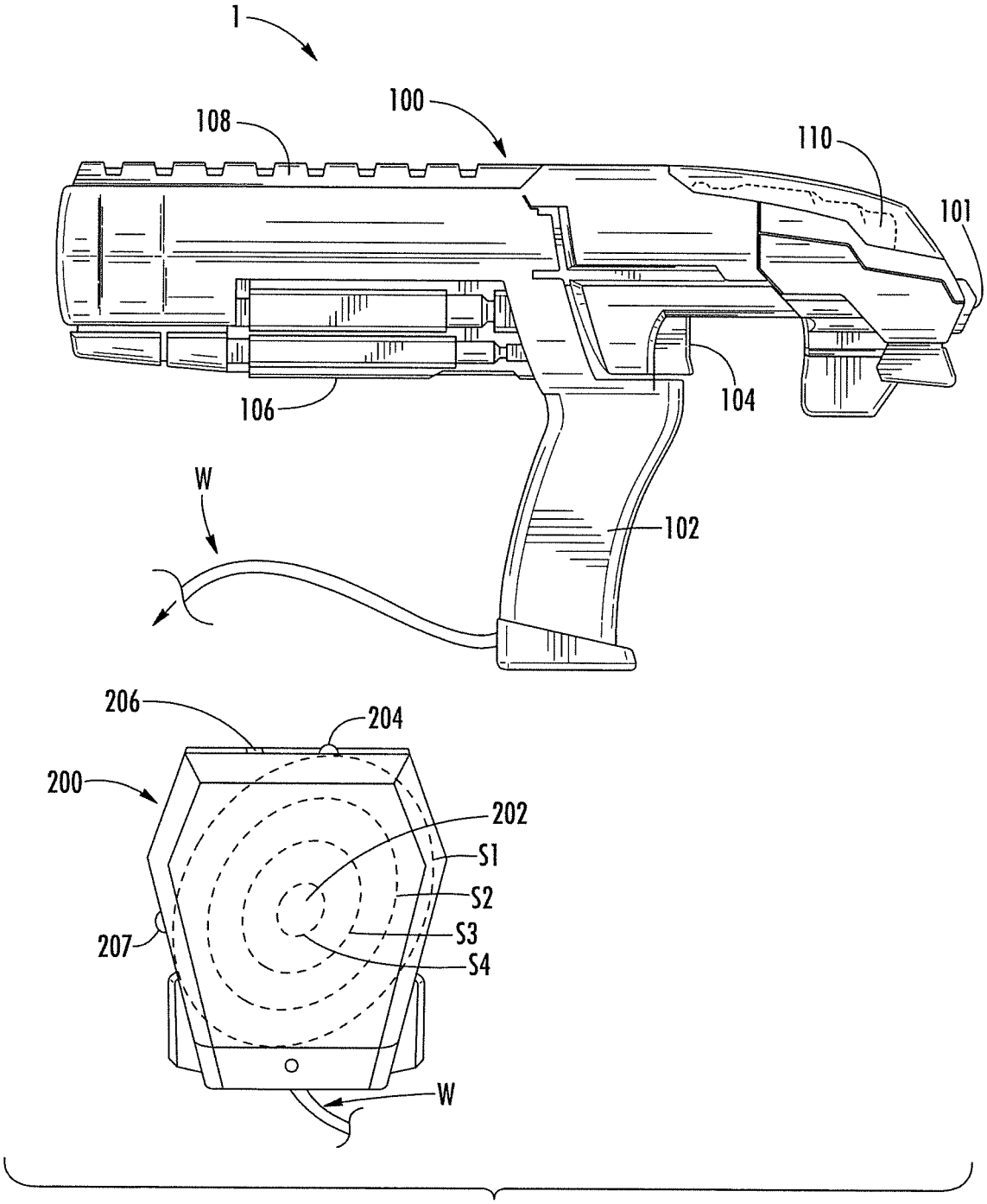
FIG. 1 is a front view of a tag system including a hand-held 'laser' blaster (emitter) and a 'laser' vest receiver (receiver target in accordance with the present disclosure)
Figure 1A:
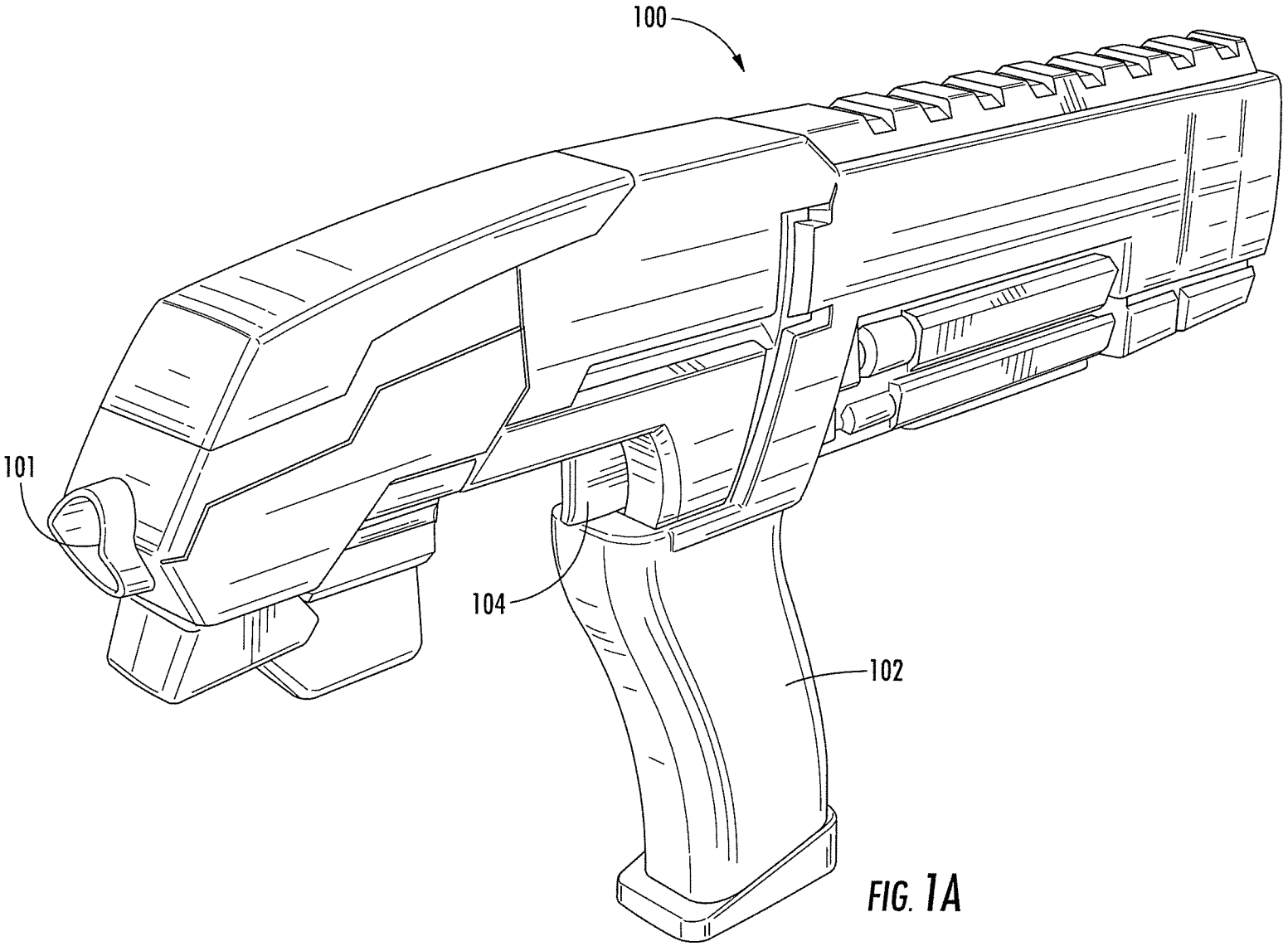
FIG. 1A is a perspective view of the blaster (emitter) of FIG. 1.
Figure 1B:
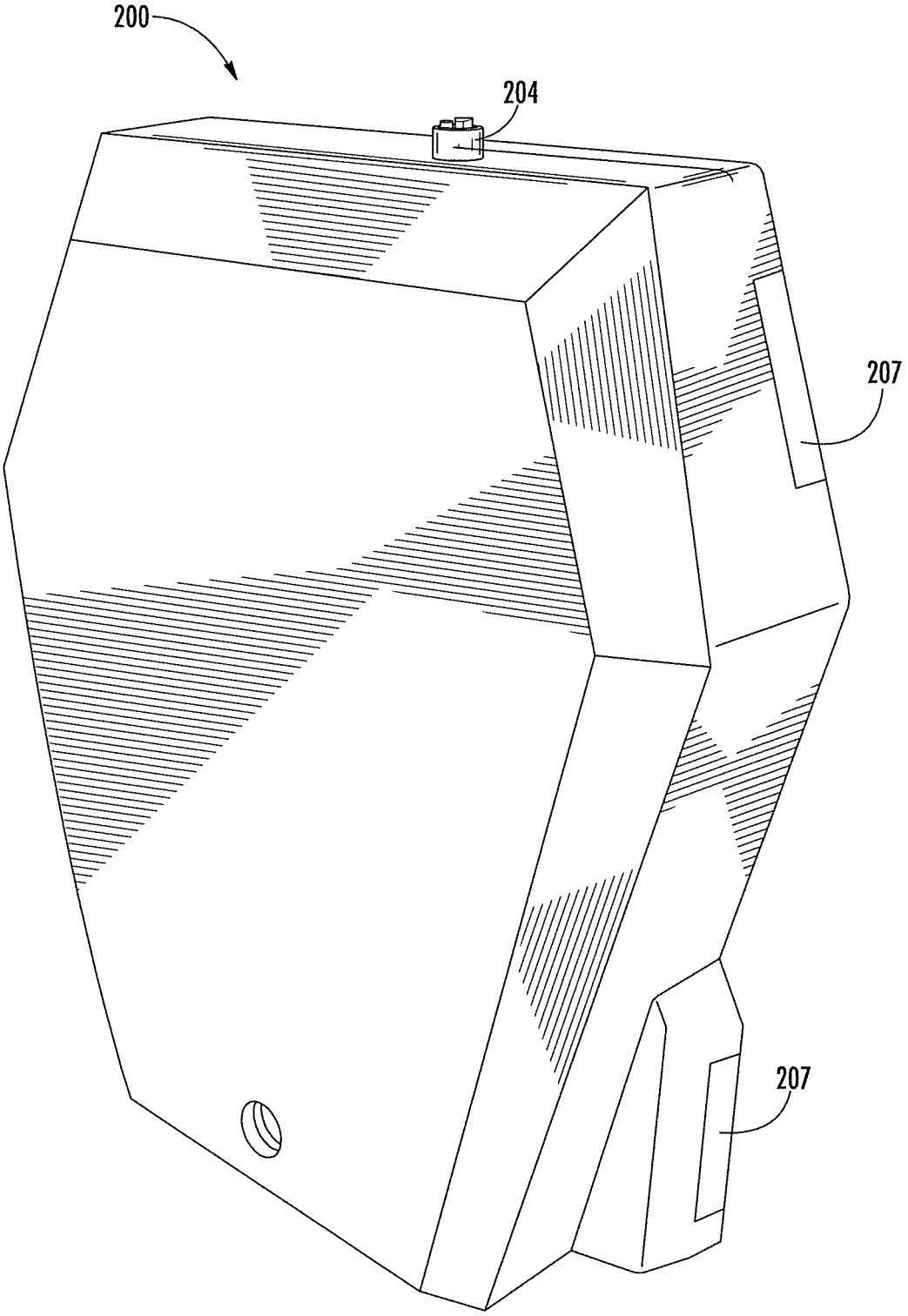
FIG. 1B is a perspective view of the vest receiver of FIG. 1.

As required, a detailed illustrative embodiment of the present invention is disclosed herein. However, techniques, systems, compositions and operating structures in accordance with the present invention may be embodied in a wide variety of sizes, shapes, forms and modes, some of which may be quite different from those in the disclosed embodiment. Consequently, the specific structural and functional details disclosed herein are merely representative, yet in that regard, they are deemed to afford the best embodiment for purposes of disclosure and to provide a basis for the claims herein which define the scope of the present invention.

Reference will now be made in detail to several embodiments of the invention that are illustrated in the accompanying drawings. Wherever possible, same or similar reference numerals are used in the drawings and the description to refer to the same or like parts or steps. The drawings are in simplified form and are not to precise scale. For purposes of convenience and clarity only, directional terms, such as top, bottom, up, down, over, above, below, etc., or motional terms, such as forward, back, sideways, transverse, etc. may be used with respect to the drawings. These and similar directional terms should not be construed to limit the scope of the invention in any manner.

As shown in FIG. 1, a tag system 1 may include an infrared emitter blaster 100 and an infrared vest receiver 200. The blaster 100 may include a handle 102 for a player to grasp and a trigger 104 positioned relative to the handle 102 to facilitate engaging of the trigger 104 by a finger of a hand grasping the handle 102. The blaster 100 may include a housing that include a battery compartment 106 to power at least one of the blaster 100 and a vest receiver 200, which may be electrically connected to the blaster 100 via an electrical cable or wire W. The blaster 100 may include an infrared transmitter 101 (at the end thereof) that is configured to send an infrared signal to be received by the vest receiver 200.

Figure 2:
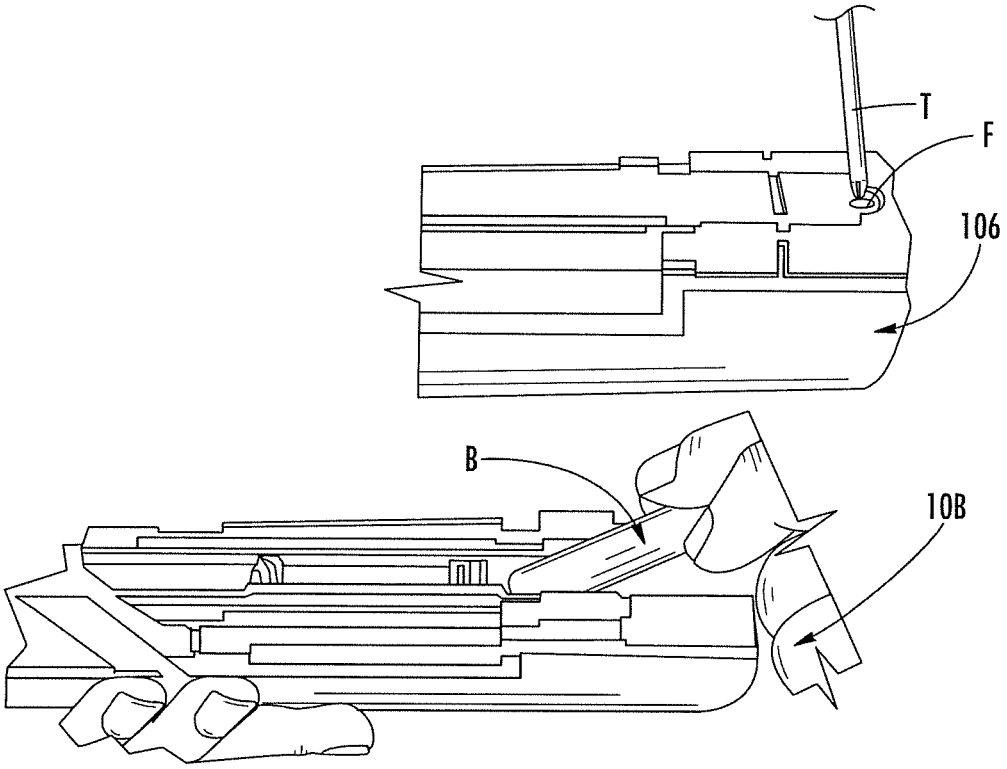
FIG. 2 is a schematic illustrating the installation of batteries to a battery compartment of the blaster of FIG. 1.
Figure 3:
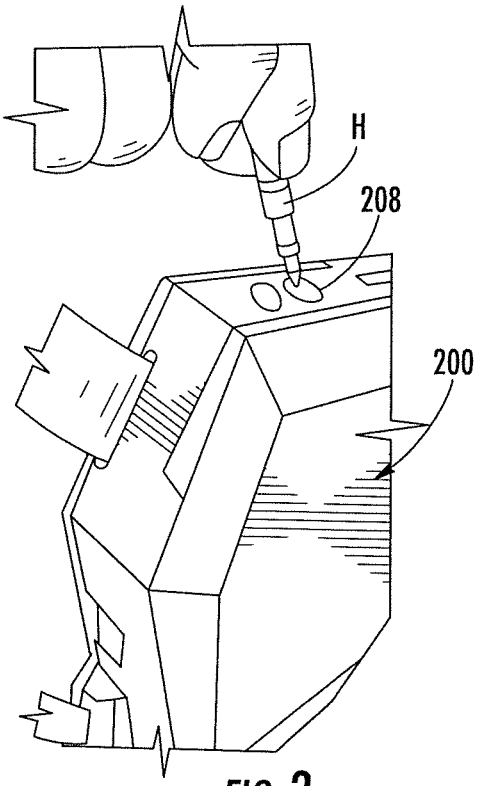
FIG. 3 is a schematic illustrating the coupling action of headphones to the vest receiver of FIG. 1.

Prior to use, as shown in FIG. 2, the battery compartment 106 may be opened by removing a fastener (e.g., a screw) by using a screwdriver T such that batteries B (e.g., AA or AAA batteries) may be installed therein. In addition, an audio listening device (e.g., headphones) may be connected to the system 1 via a wireless Bluetooth®-type or wired connection, as shown. For example, as shown in FIG. 3, headphones H may be connected to an audio jack 206 of the vest receiver 200 such that game sounds can be heard through the headphones H. Alternatively, or in addition, the vest receiver 200 may include a speaker. The vest receiver 200 may also include a button 207, which may be a wheel, or for adjusting the volume of sound that is output.

Figure 4:
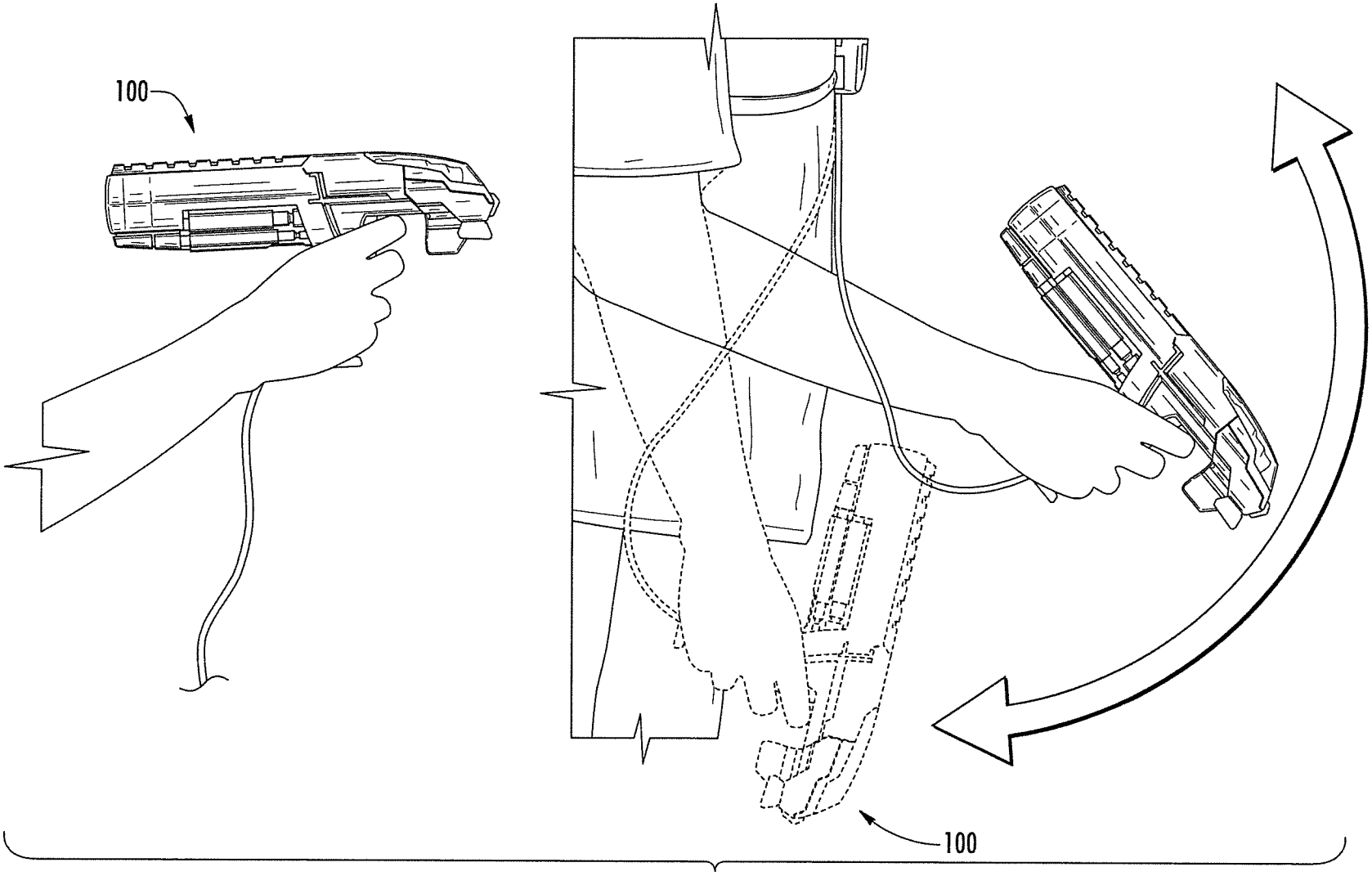
FIG. 4 is a schematic illustrating reloading of the blaster of FIG. 1.

The blaster 100 may also include a blast indicator 110 that emits a light to indicate that the emitter blaster 100 has been fired and/or a team indicator 110 that may emit a light of a particular color to designate the player's team or joint-team. The blast indicator 110 may have a predetermined length may provide an indication as to the the number of 'shots' or 'blasts' remaining before having to 'reload'. For example, the blast indicator 110 may be illuminated along its entire length, or some other location, or illuminated only upon a portion thereof, which may be illuminated upon use, or optionally upon reloading, or upon a combination of shots-remaining/shots-fired, or optionally and may become illuminated along a decreasing fraction of its length after each blast of the blaster emitter 100. It will be understood that the illumination may be determined by the system and modified in alternative system dynamics. For example, as shown in FIG. 4, the blaster emitter 100 may be 'reloaded' (e.g., an electronic memory updated to 'refresh' the amount of shots/emissions' left) by pressing the trigger 104 for a predetermined amount of time (e.g., 2 seconds) and a particular movement (e.g., shaking) of the blaster 100 as indicated by the directional arrow. For each reload, the player may get up a predetermined number (e.g., 10 shots, or 20, etc. depending upon the system designer).

Figure 5A:
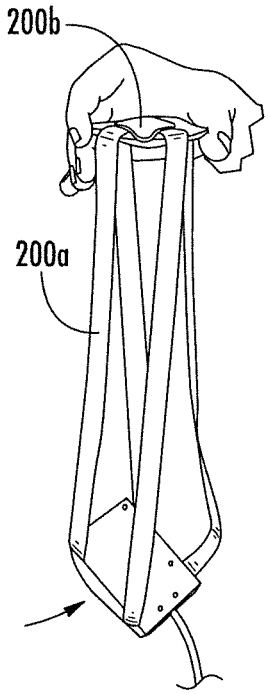
FIGS. 5(A), 5(B), and 5(C) are schematics illustrating placing the vest receiver of FIG. 1 on an upper torso of a player's body.
Figure 5B:
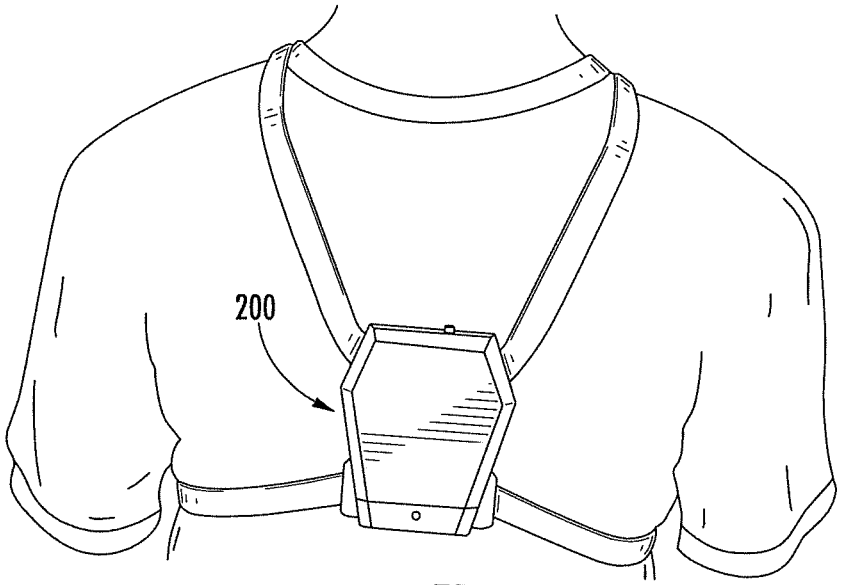
Figure 5C:
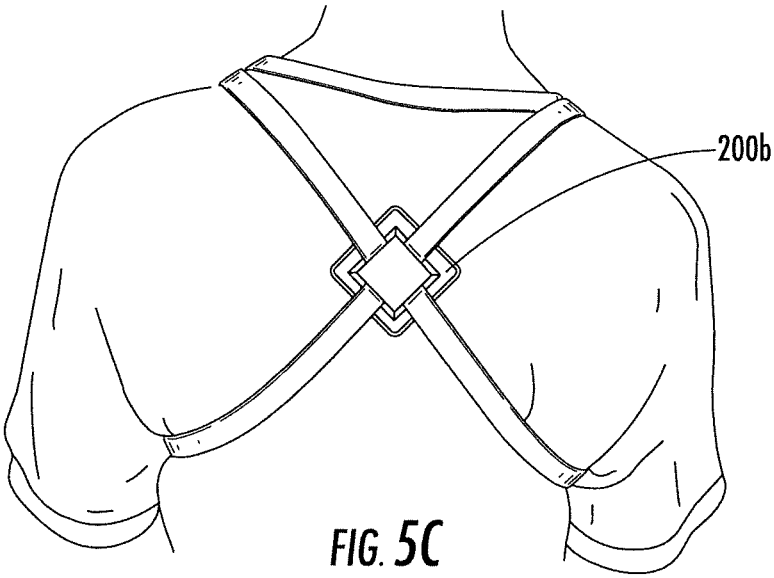
Figure 6:
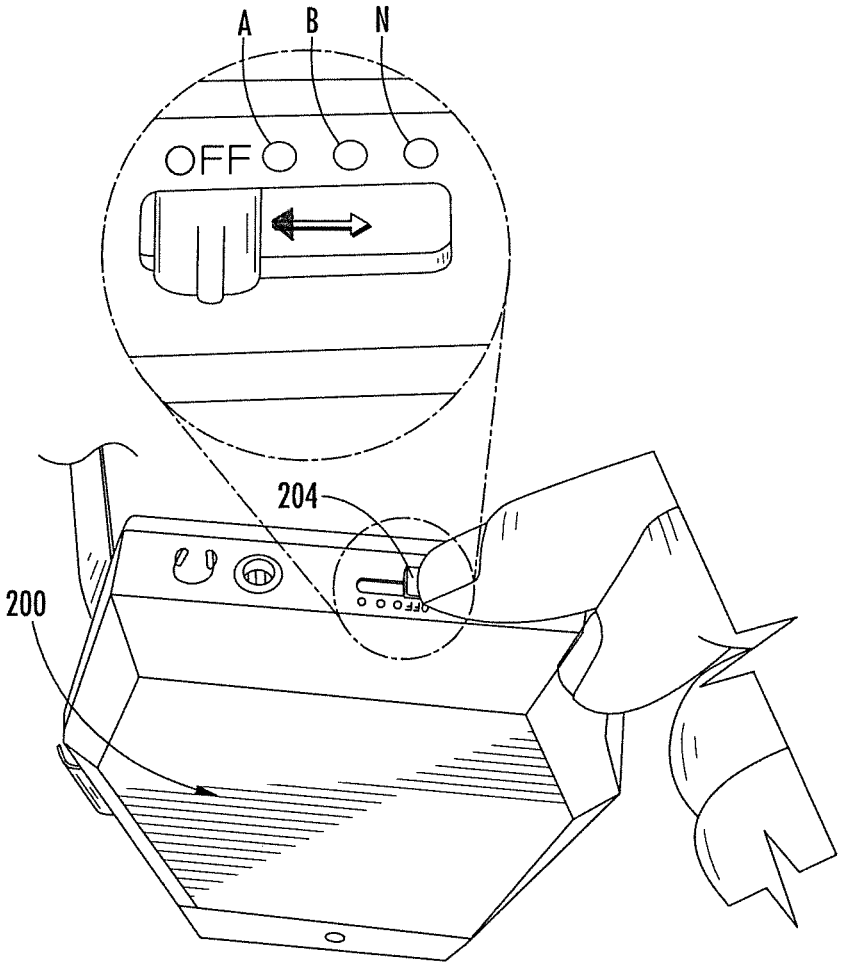
FIG. 6 is a schematic illustrating a team selection by a player by setting a team selector button of the vest receiver of FIG. 1.

The vest receiver 200 may be coupled to a strap 208, which is secured to the housing of the vest receiver via receptacles 207 extending therethrough such that it may be worn as shown in FIG. 5. In particular, FIGS. 5(A)-5(C) shows illustrating steps in wearing and the placement of the vest receiver 200 when worn. In part (a), a user holding a backplate 200*b* that is coupled to straps 200*s* that are coupled to the vest receiver 200. In part (b), the vest receiver 200 is shown strapped securely to a user's chest, and in part (c) the back of the user is shown illustrating how the backplate 200*b* looks with the straps 200*s* being received by the backpalte 200*b*. When worn the vest receiver 200 may be positioned on the chest of the player. The vest receiver 200 may be configured to receive various types of electromagnetic (EM) and/or infrared signals that are emitted by the blast transmitter 100. Upon being 'struck' (i.e., receiving an audio or light signal emitted by the vest receiver 200), the vest receiver 200 may register being struck and may provide a visual and/or tactile and/or sound indication of the receipt of the signal (e.g., turn blue, or vibrate, or say 'Hit'). Moreover, the vest receiver 200 may be configured to distinguish between particular infrared signals associated with particular blasters 100 such that it may be known which particular player, group of players (team) or which entire team (whole team) is to be credited with the hit or score, so as to avoid undue confusion in the system. Further, 'friendly' fire may optionally be prevented from generating 'hits' or may result in a demerit for the player who caused the 'friendly' fire. For example, as shown in FIG. 6, the team selector button 204 may be set such that particular players may hit and/or be hit by players from particular teams. In particular, the team selector button 204 may be set to mode A (Team A/Red Team) or mode B (Team B/Blue Team) or mode N (Team Neutral). For example, a player on team 'red' may select to be hit by team 'blue' or both team 'red' and team 'blue'; or a player on team 'blue' may select to be hit by players on team 'red' or players on both teams 'red' and 'blue'; or a player can select to be on both teams 'red' and 'blue' and may select to be hit by players who are on team 'red', team 'blue' and those on both teams 'red' and 'blue'. Additionally, multiple teams may be allowed to operate inter-operatively, so that all blues+reds vs. a third-team may be arranged depending upon a user designation.

When the vest receiver 200 receives a signal from the blaster 100, the hit indicator 202 may light up to indicate that the player has been struck. As shown in FIG. 1, the vest receiver 200 may be configured to determine the 'accuracy' of the shot and the hit indicator 202 may indicate the particular status (e.g., 'killed' or 'injured', etc.) of the player wearing the vest receiver 200 to correspond with the number and accuracy of the hits received by the vest receiver 200 of that player. In particular, the vest receiver 200 may determine the approximate distance from the center of the target of the vest receiver 200. That is, the vest receiver 200 may determine whether the hit occurred within a first zone S1, a second zone S2, a third zone S3, a fourth zone S4, and so on. It will be understood, that multiple designated zones can occur.

A method of game play will now be described. Each player may strap the vest receiver 200 to his chest. Earphones may be plugged into the headphone jack 206 and worn by the player. Using the team selector button 204, each player may select to be part of a particular team including Team A, Team B, or Neutral, for example. As discussed above, the team selector button 204 permits a player to select from a plurality of options pertaining to which team if any that player is a part. For example, the player may select between two colors corresponding to a particular team including Team A which may be red and a Team B which may be blue. The player may alternatively select a neutral team. If Team A is selected, the team indicator light 110 may be red, if Team B is selected, the team indicator light 110 may be blue, and if the Neutral Team setting is selected, there may be a continuous switching of the light between a red and a blue light. The frequency by which the light of the team indicator light changes may be every second, for example. During play, the blast indicator light 108 may be red when part of Team A or blue when part of Team B. The Neutral Team color may be a mixture of blue and red light and may be one of ten different colors, for example, by having a mixture of blue and red light such that varying shades of purple light are perceived by having the brightness or the intensity of the blue and red LED lights adjusted. Also, for example, the light emitted may alternate between red and blue, and/or may be part blue and part red (e.g., a purple shade). For example, the light emitted may be a particular color that is based upon the respective brightness or intensity levels of the blue and red lights included in the team indicator light. For example, the color may be varying shades of purple as would result from the following mixtures of light brightness/intensity: (1) blue 100% and red 0%; (2) blue 94% and red 18%; (3) blue 87% and red 37%; (4) blue 81% and red 50%; (5) blue 75% and red 62%; (6) blue 62% and red 75%; (7) blue 50% and red 81%; (8) blue 37% and red 87%; (9) blue 18% and red 93%; and (10) blue 0% and red 100%.

During play, a player may be given a predetermined number of shots, e.g., 10 shots, per each reloading. The blast indicator 108 may include one or more blinking LED lights that may indicate the number of shots remaining before having to reload. For example, the blast indicator 108 may cycle (1 cycle=off, then on, and then off). The number of cycles may correspond to the number of shots remaining as follows: (a) 10 and 9 shots=1 cycle per second; (b) 8 and 7 shots=2 cycles per second; (c) 6 and 5 shots=3 cycles per second; (d) 4 and 3 shots=4 cycles per second; (e) 2 and 1 shots=5 cycles per second.

The hit indicator 202 on vest receiver 200 may have a predetermined on-off-on cycle time and may be, for example, 1.5 seconds. The brightness or light intensity may 'pulse', that is alternate between an increasing and decreasing light intensity per cycle. Depending on the number of hits received and/or the accuracy of the hit, the hit indicator 202 may change color. For example, the color of the hit indicator 202 may have a plurality of colors in a similar manner as discussed with respect to the team indicator light 110. For example, the following number of hits may cause the color of the hit indicator 202 to be set as follows: (a) 0-1 hits may be green (green 100% intensity and red 0% intensity); (b) 2-3 hits may be a yellow/green (green 100% intensity and red 70% intensity); (c) 4 hits may be yellow (green 100% intensity and red 100% intensity); (d) 5 hits may be orange (green 70% intensity and red 100% intensity); (e) 6 hits may be dark orange (green 50% intensity and red 100%); and (f) 7 hits may be red (green 0% intensity and red 100% intensity). After the 8th hit, the hit indicator 202 may pulse or flash red quickly for a predetermined amount of time (e.g., 4 seconds) and a sound effect indicating the end of game play may be played. After the end of game play, the hit indicator 202 may have the LED light turn off.

During play, 'friendly fire' may be prevented. In particular, the vest receiver 200 may (optionally) not register hits if struck by a player that is a member of the same team. For example, if a player selects to be part of Team A that player cannot hit or get hit by other members of Team A. In addition, the team indicator 110 may glow red to indicate that that player is part of Team A. Before the blaster emitter 100 is 'loaded', the blast indicator 108 may have an indicator light that is off After loading or reloading the blast indicator 108 may have an indicator light corresponding to the color of the particular team selected (e.g., red for Team A and blue for Team B). The same is true if a player selects to be part of Team B. If a player selected to be art of a neutral team, players can hit and get hit by members of any team. In addition, the team indicator 110 may emit a light that changes between colors (e.g., red and blue) at predetermined intervals of time (e.g., 1 second). The blast indicator 108 may in an off state, i.e., not emitting light prior to loading or re-loading. After loading or reloading, the blast indicator 108 may have its own color or may alternate between colors. For all players, the vest receiver 200 may have a hit indicator that glows a particular color to indicate the 'health' of the player (e.g., green for players that are alive). The hit indicator 202 may have a light that pulsates or beats in a similar rhythm as a heart from a very bright to a less bright light intensity.

The object of the game is to 'hit' opponents' vest receiver 200, which is configured to detect an infrared signal emitted by the blaster emitter 100. As discussed above, players from the same team cannot shoot or be shot by other players. That is, the laser vest receiver 200 will not register a hit that emanated from a blaster emitter 100 of a player belonging to the same team. However, neutral players can shoot or get shot by players from any team. Each time a player is hit, the blast indicator 108 may change color and may have a particular color depending on the number of shots or blasts that were already fired, as discussed above. Successive shots or blasts may be delays by a predetermined amount of time (e.g., 0.5 seconds). Once a player is 'out', that is once a player has been hit for a predetermined number of times or suffers hits of a particular accuracy, the player cannot fire or be hit until the system 1 is rebooted (or 'restored') by turning the system off and back on again or by other re-set action. For every predetermined interval of time in which a player has not been hit, the 'health' of the player may (optionally) improve (e.g., one hit may may be removed from his count). The last player standing is the winner. This may be determined by determining which is the last player who is not 'out' or still has hits remaining as indicated by the blast indicator 108.

During play, certain sound effects may be played. For example, when a player is hit, the player may here "You're hit!". When there are a predetermined number (e.g., 2) of hits remaining as indicated by the blast indicator 108, the player may here "You only have 2 hits left." If a player's 'game-health' improves such that the player earns back the number of hits the player has until being 'out', the player may hear randomly "You have one hit back." If the player is hit a predetermined number of times within a predetermined amount of time, the player may randomly hear "Get out of here!" or "Go! Go! Go!" When the player is out, the player may randomly hear "You're out!" or "You're done!" or "Game over." Particular sound effects may have varying degrees of priority. For example, "You are hit" may have the lowest priority and may not be sounded when other sound effects may be played to indicate other occurrences of other game events. Throughout the game play, a background sound or music may play and/or repeat with a predetermined frequency.

Figure 7A:
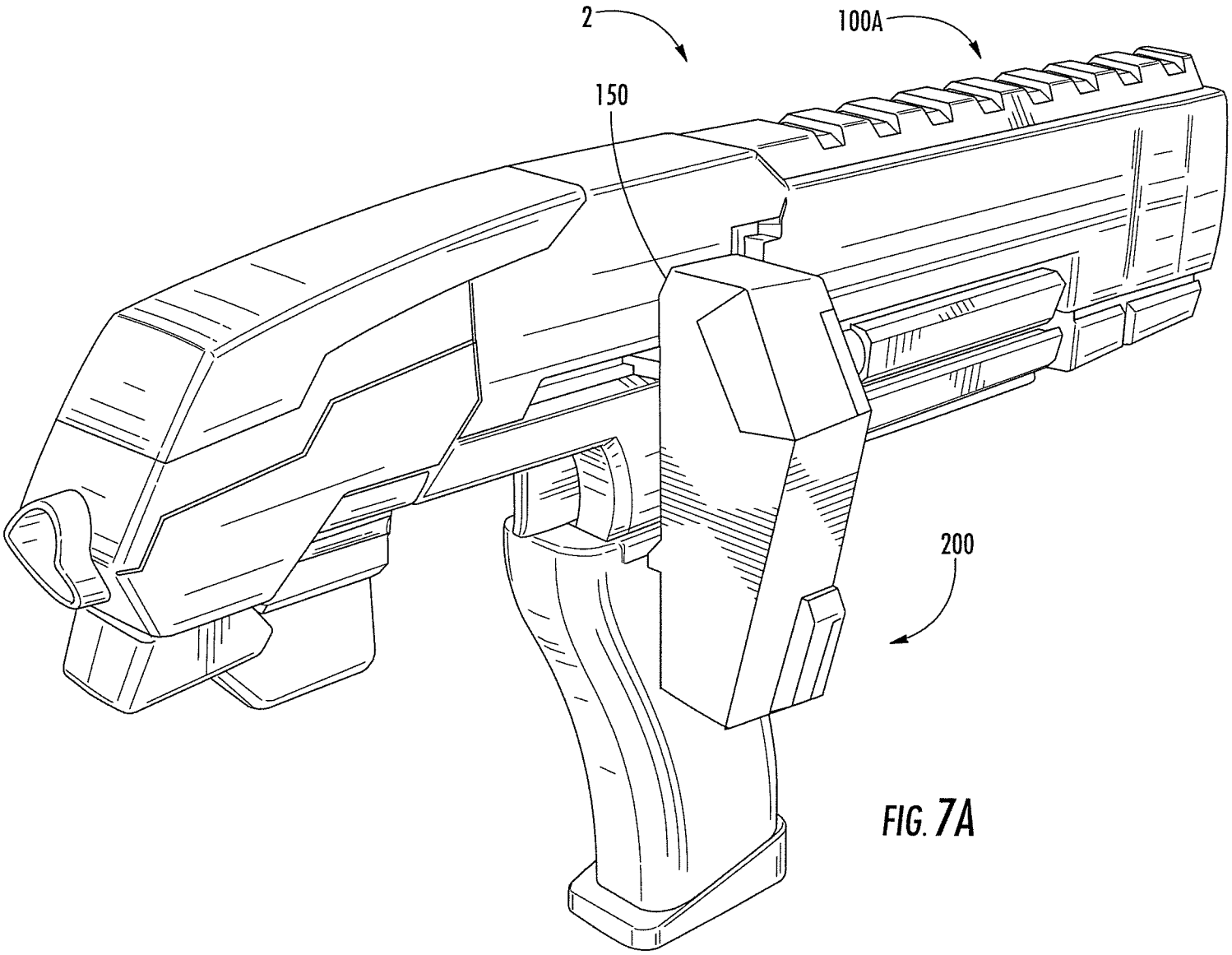
FIG. 7A is a front perspective view of an alternative blaster-emitter in combination with a receiver system and FIG. 7B is a back perspective view of the tag system of FIG. 7A.
Figure 7B:
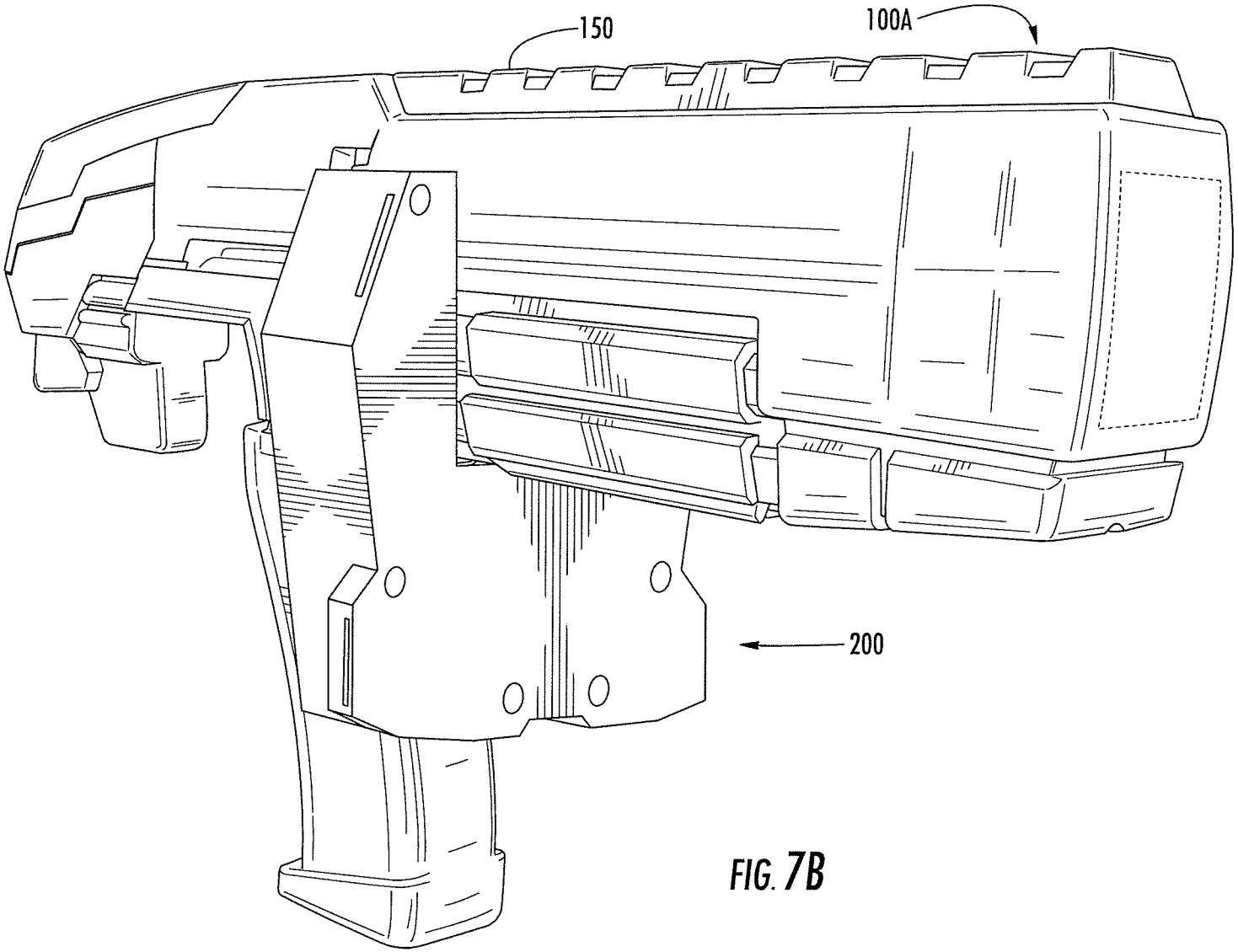

A system 2, which is substantially similar to the system 1, except in the following ways is now described and shown in FIGS. 6-7. As shown in FIGS. 6-7, the system 2 may include a blaster emitter 100A, which is substantially similar to the blaster emitter 100 except that it includes a receptacle or a dock 150 for the vest receiver 200. In this embodiment, it is not necessary for the player to wear the vest receiver 200 as this device will be removably-coupled to the blaster emitter 100A/100.

It is to be understood that the blaster emitters 100, 150 may not project a true 'laser' but rather are infrared emitters that project infrared light of a particular wavelength for the particular team so-indicator that is received by the selected vest receiver 200 or device 200 which is configured to be an infrared receiver for that particular signal.

Figure 8A:
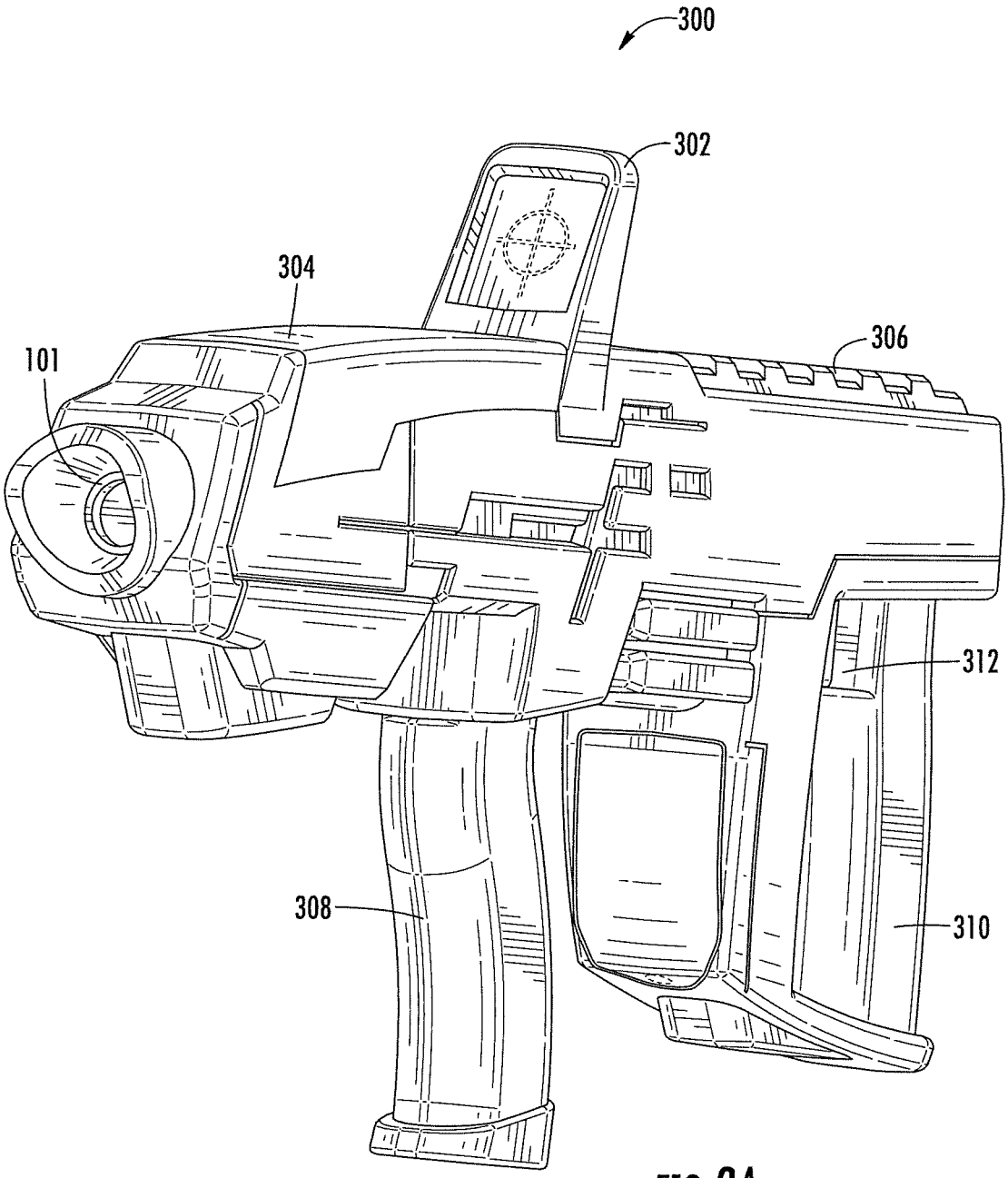
FIG. 8A is a front perspective view of an alternative blaster-emitter.
Figure 8B:
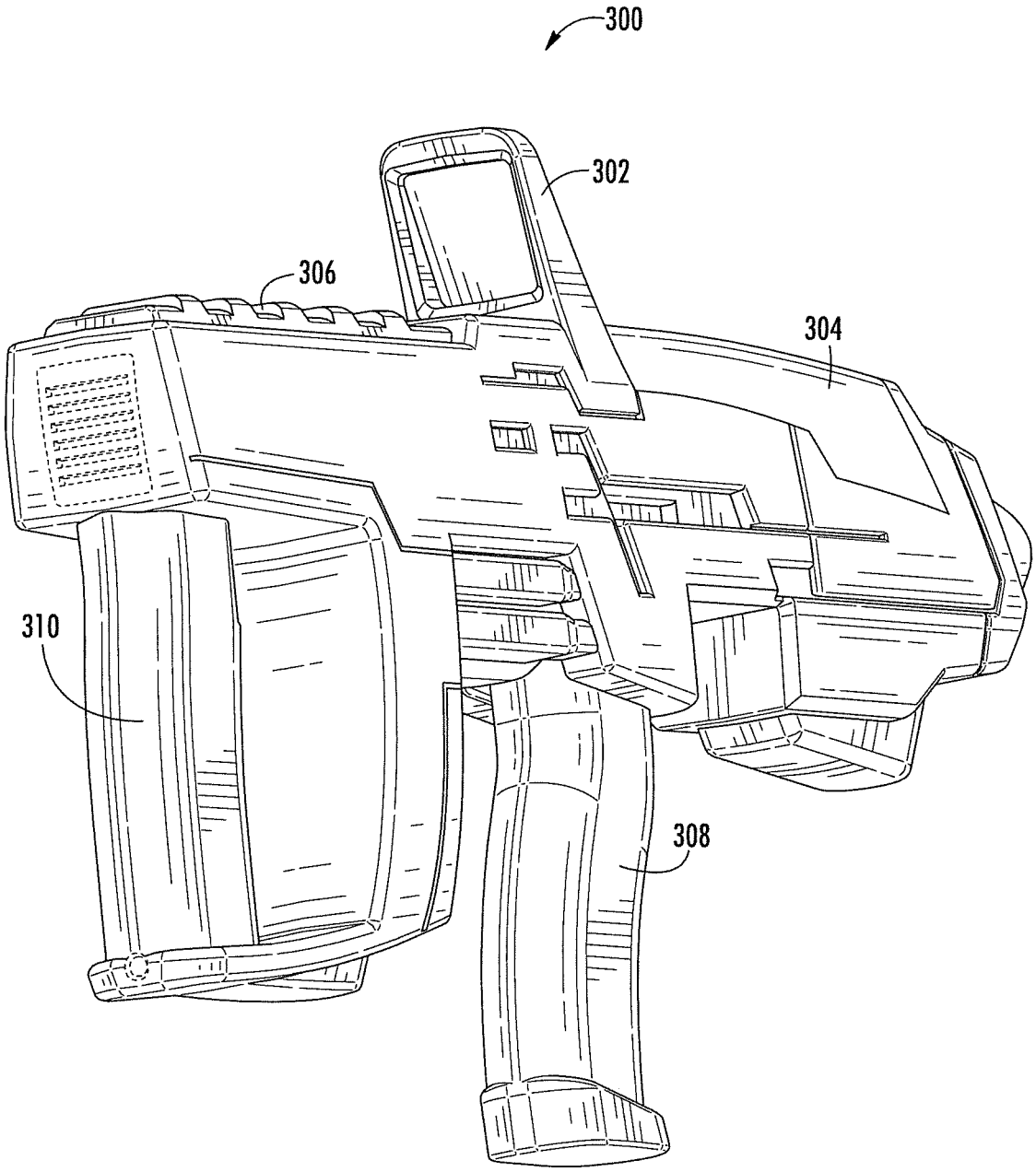
FIG. 8B is a rear perspective view of the blaster-emitter of FIG. 8A.
Figure 9:
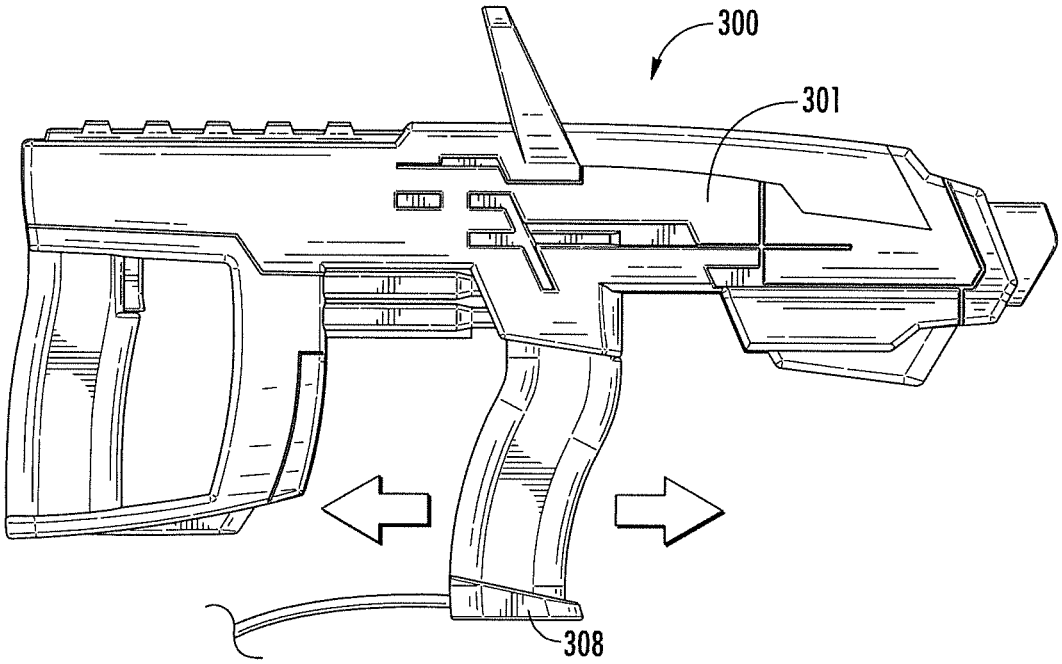
FIG. 9 is a front view of the blaster-emitter of FIG. 8A illustrating an operation thereof.
Figure 10:
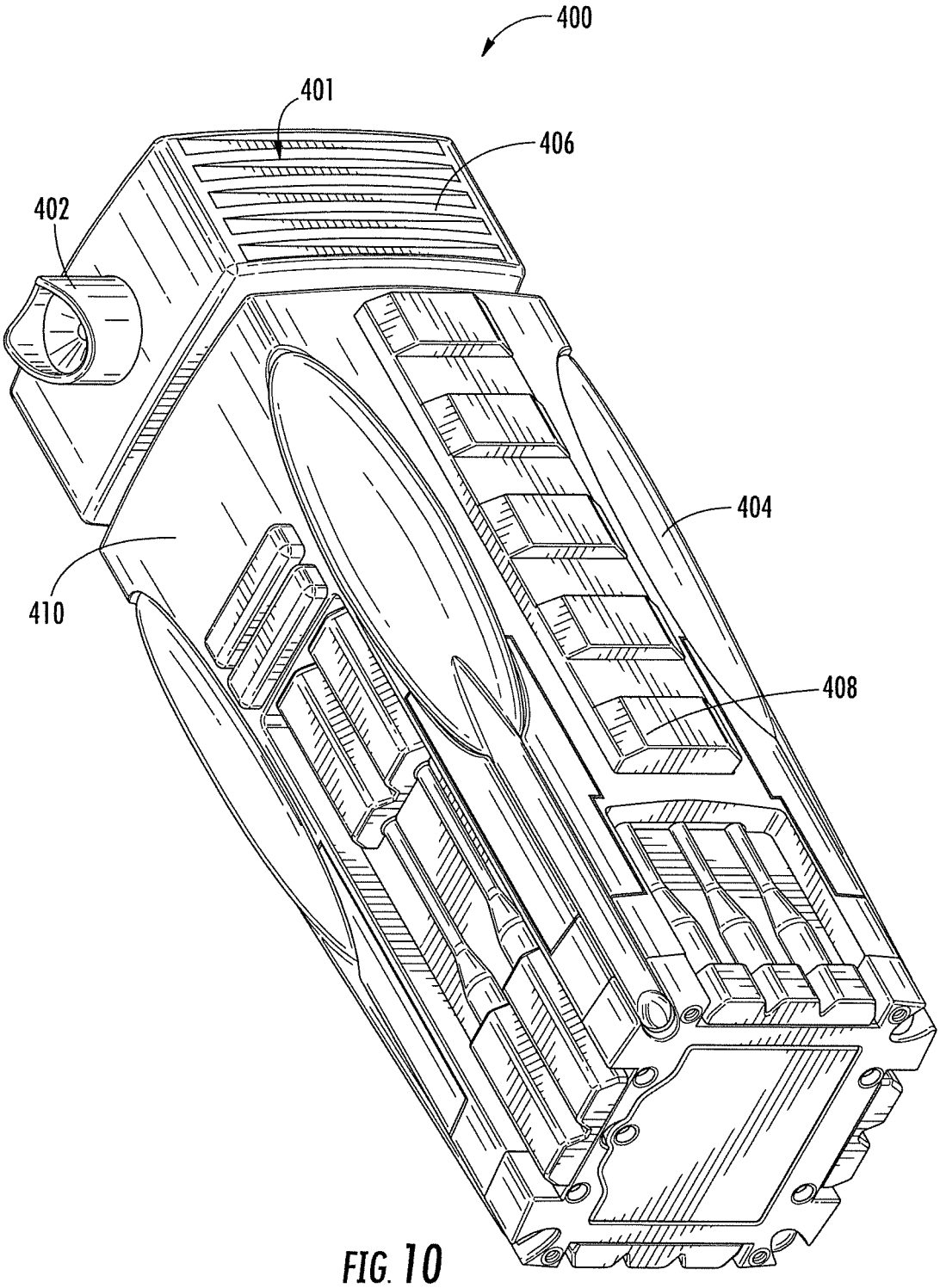
FIG. 10 is a front perspective view of an interactive gaming tower.
Figure 11:
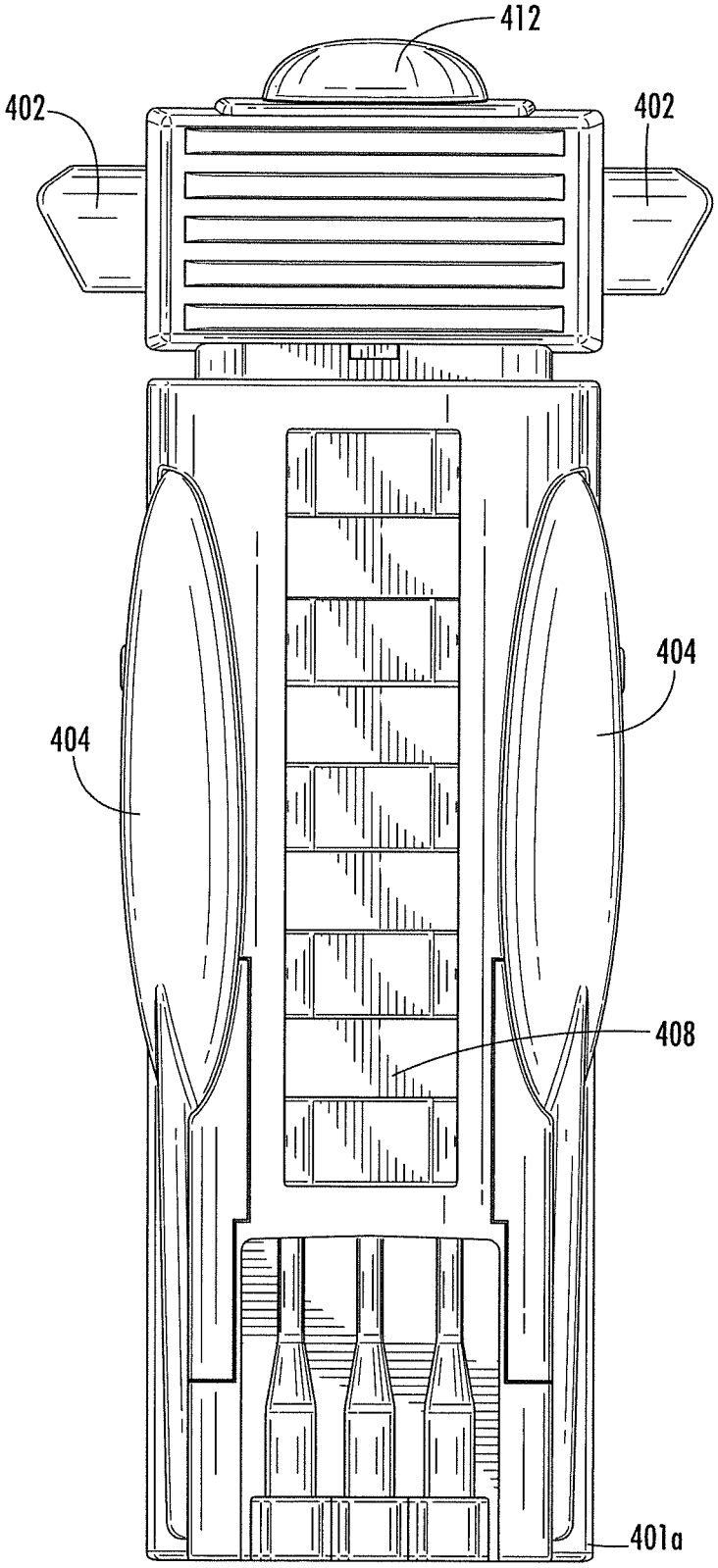
FIG. 11 is a side view of the interactive gaming tower of FIG. 10.

An alternative blaster emitter (infrared) 300 is now described with respect to FIGS. 8-9. The blaster emitter 300 may replace the blaster emitters described hereinabove including the blaster emitters 100, 100A, and may include the features described with respect to those blaster emitters except in the ways described herein.

The blaster emitter 300 may include a scope 302 which may facilitate accurate aiming of the blaster emitter 300 at a target. A front section of the blaster emitter 300 may include a team indicator 304 which may emit a light having a color or pattern corresponding to the team of the player. A blast indicator 306 may provide a visual indication of the number of 'shots' remaining. For example, the blast indicator 306 may be illuminated along its entire length when a full number of shots are remaining and may gradually be illuminated along a lesser length of the blast indicator 306 as the number of shots decreases as the blaster emitter 300 is fired. The blast emitter may include a front handle 308 and a rear handle 310. The rear handle 310 may include a trigger 312, and may be gripped by one of the user's hands while the front handle 308 is gripped by the other hand of the user. One of the handles, for example, the front handle 308 may house a battery compartment for providing a power source to the blaster emitter 300.

As described above with respect to the blaster emitters 100, 100A may be 'reloaded' by shaking the emitters 100, 110A. The blaster emitter 300 may be reloaded in the same manner. However, as shown in FIG. 9, the blaster emitter 300 may be reloaded by ratcheting or sliding the front handle 308 back and forth. In particular, the handle 308 may be pivotable or slidable and may be moved back and forth in the direction of arrows 1 and 2 respectively. As shown in FIG. 9, the handle 308 may be slidable relative to the housing 301 of the blaster emitter 300, and the sliding of the handle 308 back and forth may effect reloading the number of 'blasts' remaining. Each 'reload' may result in the user being given a predetermined number of 'shots' or 'blasts', e.g., 25 shots or blasts.

Pressing the trigger 312 may result in firing (e.g., emission of an infrared signal) of the blaster emitter 300. Pressing and holding the trigger 312 may result in a rapid fire or simulated automatic mode of firing.

An interactive gaming tower 400 is now described with reference to FIGS. 10-13. The gaming tower 400 is configured to be a stationary device that both receives and transmits signals to the players. Various modes of gameplay utilizing the tower 400 are described below.

The interactive gaming tower 400 may include a housing 401 which may be have a shape that is generally a rectangular prism. Mounted at the top of the housing 401 on opposing faces thereof, may be an infrared emitter 402. At each corner of the housing 401, a retractable leg 404 may be disposed. In other words, the tower may include four retractable legs 402 each of which is pivotably or foldably connected to a corner 401*a* of the housing 401. A speaker 406 and a light 408, as well as a display (e.g., LED) 410, may also be provided. An on/off switch 412 may be provided, for example, on an upper surface of the housing 401.

Figure 12A:
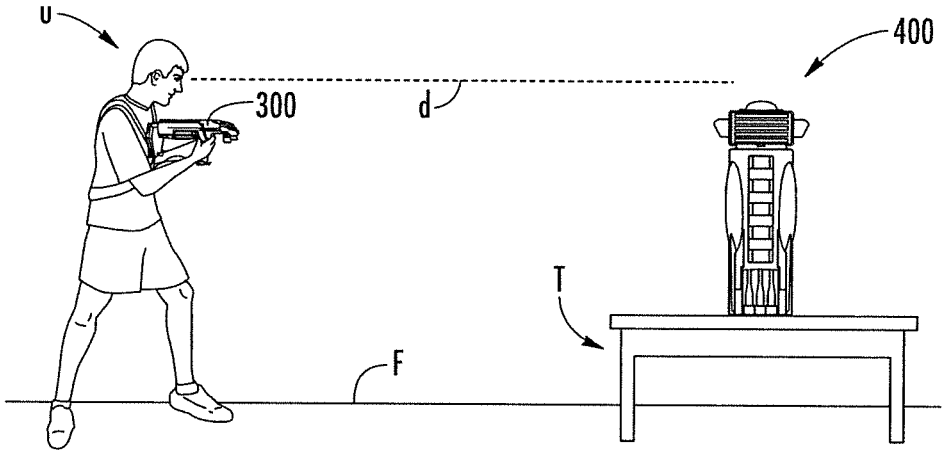
FIGS. 12A-12B are illustrations of proper setup of the gaming tower of FIG. 10.
Figure 12B:
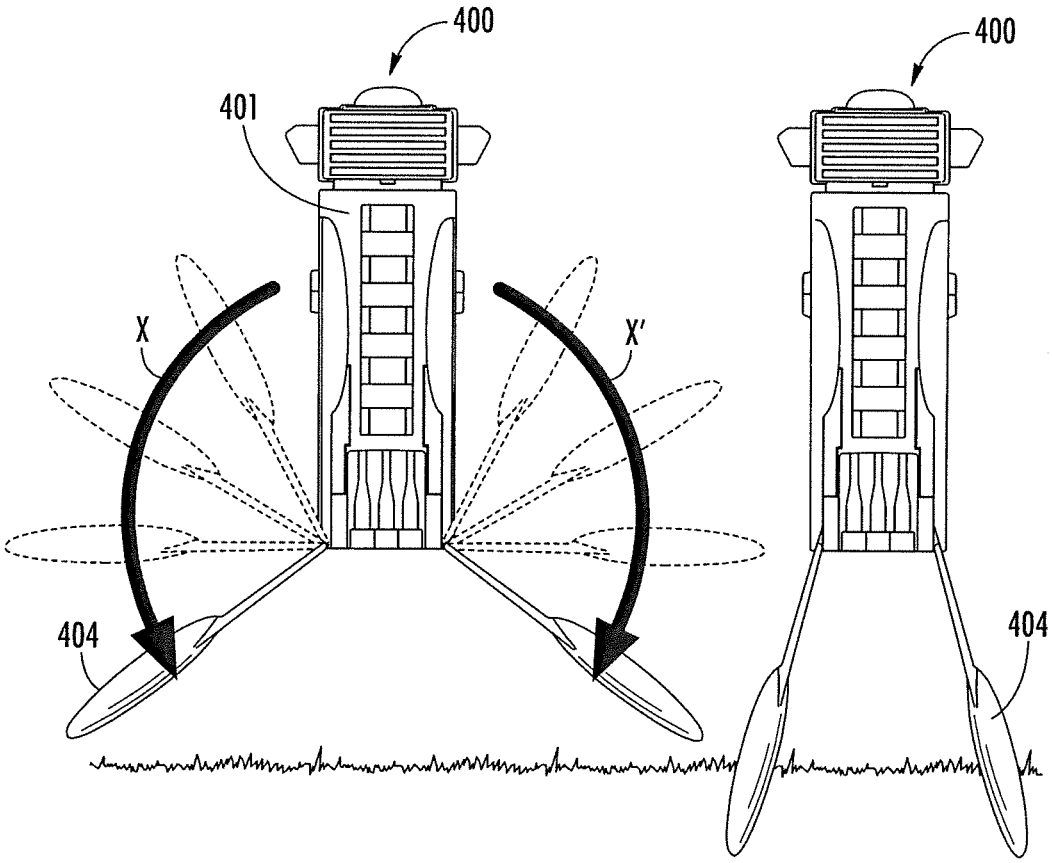

As shown in FIG. 12A, the tower 400 is shown in use in which a user U may stand at a distance d, e.g., within 40 feet, from the tower 400 for an infrared emission to be detected by the tower 400. As shown in FIG. 12A, the tower 400 may be placed on a table T such that reception/detection of infrared signals by the tower 400 is facilitated. Alternatively, as shown in FIG. 12B, legs 404 may be deployed from the tower 400 such that the height of the tower relative to a floor F is increased. A table T may still be preferred such that the tower 400 is on a level or stable surface.

As shown in FIG. 12B setting up the tower 400 may be done by deploying legs 404 by pivoting the legs 404 downward away from the housing 401 in direction X. The tower 400 may be configured to both receive an emit infrared (IR) signals to and from the players. For example, the tower 400 may receive an IR signal emitted by at least one blaster 100, 100A, 300 and may also be configured to emit a signal to a receiver of a player. Preferably, the tower 400 is set up such that the top of the tower 400 is below eye level of the players. Thus, when placing the tower 400 on a high surface, its legs 404 need not be deployed. However, when such a surface is unavailable, the legs 404 may be deployed to increase the height of the tower 400.

Figure 13:
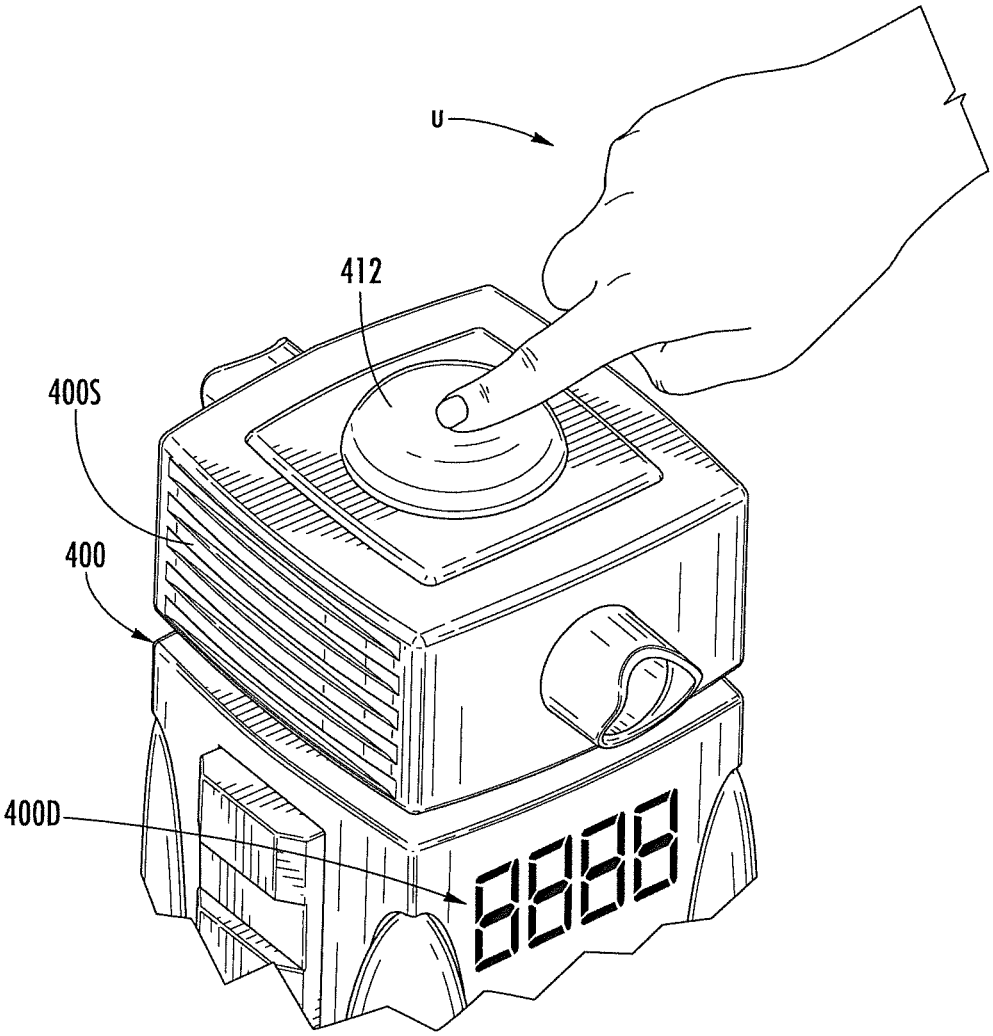
FIG. 13 is an illustration of starting a game using the gaming tower of FIG. 10.

As shown in FIG. 13, a game may be started by depressing the on-off switch 412. A series of short beeps and then a long beep may signal the start of a game which may be emitted by a speaker 400S. A display 400D, e.g. an LED or LCD display, may display user or team scores, as well as, remaining game time, for example.

Various games may be selected for play. For example:

| Game # | Teams | How is the game played? | Game Setting | Game Over |
|---|---|---|---|---|
| 1 | R or B | Aim and shoot at the light emitted by the tower 400 before it goes out. For example, at a purple light. | The light emitted by the tower stays on for a shorter time each successive round. | The game ends when the light is not blasted before the light goes out. |
| 2 | R and B | Aim and shoot at the light emitted by the tower 400 before it goes out and before the opponent blasts it. For example, at a purple light. | The light emitted by the tower stays on for a shorter time each successive round. | The game ends when the light is not blasted by either player or team before it goes out. |

-continued

| Game # | Teams | How is the game played? | Game Setting | Game Over |
|---|---|---|---|---|
| 3 | R or B | Aim and shoot at a light emitted by the tower 400. For example, shoot at a red light and not at a green light. | The red and green lights get faster each successive round. | The game ends if the correct light is not blasted or if the wrong light is blasted. |
| 4 | R and B | Aim and shoot at a light emitted by the tower 400. For example, shoot at a red light and not at a green light. Do this before the opposing team. | The red and green lights get faster each successive round. | After a predetermined amount of time, the team or player with the most hits wins. |
| 5 | R or B | Blast a light emitted by the tower (e.g., a purple light) before it goes out or before the tower blasts the player. | The purple light stays on for shorter times at each successive round. | When a player is blasted a predetermined number of times, the game ends. |
| 6 | R and B | Blast the purple light before the opposing team or before the tower blasts you. | The purple light stays on for shorter times at each successive round. | When a player is blasted a predetermined number of times, the game is over. The surviving players win. |
| 7 | R or B | Blast a red light as many times as you can while the light is lit. | The red light will turn on and off randomly throughout the game. | The total game time is for a predetermined period of time, e.g., 20 seconds. |
| 8 | R and B | Blast the red light as many times as possible while it is lit. | Red light will turn on and off randomly throughout the game. | Total game time is 20 seconds. Player with the most blasts wins. |
| Special Modes: | | | | |
| 9 | R and B | During a regular game, the tower 400 may be blasted by a player and repeat the signal up to a predetermined range to target particular players (e.g., the opposing team) | | |
| 10 | R and B | During a regular game, points may be scored by blasting the tower when the light is purple. First team to score a pre-determined number of hits, wins. | | |

Nothing herein shall indicate that the phrase 'laser' as used herein requires the use of an actual laser (collimated light) and it will be understood that it is descriptively used in a game-tag-manner; and will be understood as an emitter of variable energy, for example an infrared (IR) or other wavelength in the electromagnetic (EM) spectrum, and will not require the use of a actual laser.

Although only a few embodiments have been disclosed in detail above, other embodiments are possible and the inventors intend these to be encompassed within this specification. The specification describes certain technological solutions to solve the technical problems that are described expressly and inherently in this application. This disclosure describes embodiments, and the claims are intended to cover any modification or alternative or generalization of these embodiments which might be predictable to a person having ordinary skill in the art.

Those of skill would further appreciate that the various illustrative logical blocks, modules, circuits, and algorithm steps necessary to achieve the discussed functions and features herein described in connection with the embodiments disclosed herein may be implemented as electronic hardware, computer software running on a specific purpose device that is programmed to carry out the operations described in this application, or combinations of both. To clearly illustrate this interchangeability of hardware and software, various illustrative components and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the exemplary embodiments.

The various illustrative logical systems, functions, and circuits for enabling the same described in connection with the embodiments disclosed herein, may be implemented or performed with a general or specific purpose processor, or with hardware that carries out these functions, e.g., a Digital Signal Processor (DSP), an Application Specific Integrated Circuit (ASIC), a Field Programmable Gate Array (FPGA) or other programmable logic device, discrete gate or transistor logic, discrete hardware components, or any combination thereof designed to perform the functions described herein. A general purpose processor may be a microprocessor, but in the alternative, the processor may be any conventional processor, controller, microcontroller, or state machine. The processor can be part of a computer system that also has an internal bus connecting to cards or other hardware, running based on a system BIOS or equivalent that contains startup and boot software, system memory which provides temporary storage for an operating system, drivers for the hardware and for application programs, disk interface which provides an interface between internal storage device(s) and the other hardware.

A processor may also be implemented as a combination of computing devices, e.g., a combination of a DSP and a microprocessor, a plurality of microprocessors, one or more microprocessors in conjunction with a DSP core, or any other such configuration. These devices may also be used to select values for devices as described herein for use with the gaming system.

A software module may reside in Random Access Memory (RAM), flash memory, Read Only Memory (ROM), Electrically Programmable ROM (EPROM), Electrically Erasable Programmable ROM (EEPROM), registers, hard disk, a removable disk, a CD-ROM, or any other form of tangible storage medium that stores tangible, non-transitory computer based instructions. An exemplary storage medium is coupled to the processor such that the processor can read information from, and write information to, the storage medium. In the alternative, the storage medium may be integral to the processor. The processor and the storage medium may reside in reconfigurable logic of any type.

In one or more exemplary embodiments, the functions described may be implemented in hardware, software, firmware, or any combination thereof. If implemented in software, the functions may be stored on or transmitted over as one or more instructions or code on a computer-readable medium. Computer-readable media includes both computer storage media and communication media including any medium that facilitates transfer of a computer program from one place to another. A storage media may be any available media that can be accessed by a computer. By way of example, and not limitation, such computer-readable media can comprise RAM, ROM, EEPROM, CD-ROM or other optical disk storage, magnetic disk storage or other magnetic storage devices, or any other medium that can be used to carry or store desired program code in the form of instructions or data structures and that can be accessed by a computer.

Also, the inventors intend that only those claims which use the words "means for" are intended to be interpreted under 35 USC 112, sixth paragraph. Moreover, no limitations from the specification are intended to be read into any claims, unless those limitations are expressly included in the claims.

Having described at least one of the preferred embodiments of the present invention with reference to the accompanying drawings, it is to be understood that such embodiments are merely exemplary and that the invention is not limited to those precise embodiments, and that various changes, modifications, and adaptations may be effected therein by one skilled in the art without departing from the scope or spirit of the invention as defined in the appended claims. The scope of the invention, therefore, shall be defined solely by the following claims. Further, it will be apparent to those of skill in the art that numerous changes may be made in such details without departing from the spirit and the principles of the invention. It should be appreciated that the present invention is capable of being embodied in other forms without departing from its essential characteristics.

What is claimed is:

1. A gaming system, comprising:

a first infrared signal emitter having a first housing;

said first infrared signal emitter configured to emit a first infrared signal, the first infrared emitter being configured to emit a predetermined number of emissions per a simulated reloading action, the first infrared signal being configurable by a process controller to be associated with one of at least a first team, a second team, and a neutral team, the first infrared signal emitter including a first handle to be grasped by a player and a first trigger to effect emission of the first infrared signal;

a second infrared signal receiver having a second housing;

said second infrared signal receiver configured to receive the first infrared signal associated with one of the at least the first team, the second team, and the neutral team, the infrared signal receiver being operably joined to said infrared signal emitter and including a user harness to prevent unintended separation during a gaming session; and the first infrared signal receiver configured to determine a proximity of a source of the received emitted infrared signal relative to a central location designation of the first infrared signal receiver.

2. The gaming system of claim 1, further comprising:

a second handle positioned proximally relative to the first handle, the first trigger being disposed along a length of the second handle, the first handle being slidable toward and away from the second handle to effect the simulated reloaded action.

3. The gaming system of claim 1, wherein:

the first infrared signal emitter further comprising:

a first motion sensor, and wherein the simulated reloading action includes pressing the first trigger and shaking the first motion sensor.

4. The gaming system of claim 1, further comprising:

a gaming tower configured to be placed at a stationary location, the gaming tower further comprising:

a tower housing having a plurality of support legs;

a second infrared tower signal emitter configured to emit a second infrared tower signal;

at least one second infrared tower signal receiver configured to receive the first infrared signal from said first infrared signal emitter, wherein reception of the first infrared signal by the second infrared tower signal receiver results in a predetermined response.

5. The gaming system of claim 4, wherein:

the predetermined response is setting a game play mode.

6. The gaming system of claim 5, wherein:

the game play mode includes at least setting a timer.

7. The gaming system of claim 5, wherein:

the game play mode includes emitting a second infrared signal by a second infrared signal emitter upon receiving the first infrared signal by the second infrared signal receiver.

8. The gaming system of claim 5, wherein:

at least one second infrared signal receiver includes a first team infrared signal receiver and a second team infrared signal receiver.

9. The gaming system of claim 4, wherein:

the gaming tower is configured to have an adjustable height by adjusting a projecting amount of said support legs relative to said tower housing.

10. The gaming system of claim 9, wherein:

the gaming tower includes at least one of said support legs that is pivotable relative to the tower housing such that the adjustable height is settable at least at a first height and a second height.

11. The gaming system, according to claim 1, further comprising:

a motion sensor being disposed within at least one of said first housing and said second housing, the motion sensor being configured to detect a shaking movement, the shaking movement being configured to effect a simulated reloading action, the simulated reloading including at least one of a sound, color, and vibration, the simulated reloading effecting a predetermined number of shooting rounds, each of the shooting rounds being a signal emission by the signal emitter, the signal emission being an infrared signal.

12. The gaming system of claim 1, further comprising:

a wearable signal receiver.

13. The gaming system, according to claim 1, further comprising:

at least one of said first and said second housing having a first end and a second end;

a first handgrip extending from the at least one said first and said second housing and being configured to be grasped by a player, the first handgrip being disposed between the first and second ends;

a second handgrip disposed at the first end, the first handgrip being slidable relative to the second handgrip;

at least one of said first and said second signal emitter disposed at the second end; and a computer having a processor and a memory;

wherein sliding of the first handgrip and the second effects a simulated reloading, the simulated reloading effecting a predetermined number of shooting rounds, each of the shooting rounds being a signal emission by the at least one signal emitter, the signal emission being an infrared signal.

14. The gaming system, according to claim 1, further comprising:

a tower housing configured to be placed at a stationary location;

an infrared signal emitter configured to emit a second infrared signal;

at least one tower infrared signal receiver configured to receive the first infrared signal, wherein reception of the first infrared signal by the second infrared signal receiver results in a predetermined response; and a computer having a processor and a memory, the memory including at least one instruction for effecting a predetermined response in response to the at least one tower infrared signal receiver detecting an infrared signal from at least one of a first and a second team.

15. The signal emitter of claim 14, wherein the at least one tower infrared signal receiver includes a first tower infrared signal receiver and a second tower infrared signal receiver, wherein the predetermined response differs based on whether the first or the second tower infrared signal receiver detects the infrared signal.

16. The signal emitter of claim 15, wherein a first colored light is associated with the first tower signal receiver and a second colored light is associated with the second tower signal receiver.

* * * * *